United States Patent [19]

Iwasaki et al.

[11] Patent Number: 4,690,839

[45] Date of Patent: Sep. 1, 1987

[54] METHOD FOR MANUFACTURING THICK ASPHALT SHEET

[75] Inventors: Takashi Iwasaki; Yasuo Tomita; Tsunekazu Hayashi, all of Tokyo, Japan

[73] Assignee: Mitsuboshi Sangyo Co. Ltd., Tokyo, Japan

[21] Appl. No.: 695,192

[22] Filed: Jan. 25, 1985

[30] Foreign Application Priority Data

Jan. 26, 1984 [JP] Japan ..... 59-12946
Apr. 6, 1984 [JP] Japan ..... 59-69667

[51] Int. Cl.[4] ..... B05D 1/28; B05D 3/12; B05C 3/02; B05C 3/12

[52] U.S. Cl. ..... 427/366; 118/412; 118/419; 118/424; 427/428; 428/337; 428/489

[58] Field of Search ..... 427/366, 428, 389.9; 118/412, 419, 420, 424; 428/489, 490, 491, 337

[56] References Cited

U.S. PATENT DOCUMENTS 3,843,389 10/1974 Enomoto ..... 118/424 X
4,107,375 8/1978 Iwasaki et al. ..... 428/489 X

OTHER PUBLICATIONS

Japanese literature "Nonwoven Fabrics", published May 15, 1983, p. 45.
Booth, Coating Equipment and Process, p. 86 (1970).

*Primary Examiner*—Michael R. Lusignan
*Attorney, Agent, or Firm*—Cushman, Darby & Cushman

[57] ABSTRACT

A method for manufacturing a thick asphalt sheet comprises preparing a thick sheet material made of nonwoven fabric of synthetic material, passing said sheet material through at least one pair of pressing rolls from the upper side to the lower side and feeding and storing molten petroleum asphalt into a concavity formed on the upper side of said pair of rolls, whereby the molten petroleum asphalt is pressed into the sheet material when said material passes through said pair of rolls, thereby forming an asphalt sheet. The asphalt sheet thus manufactured is immediately led onto a processed ground surface to form a waterproofing layer thereon.

8 Claims, 4 Drawing Figures

METHOD FOR MANUFACTURING THICK ASPHALT SHEET

BACKGROUND OF THE INVENTION

1. Field of the Invention:

The present invention relates to a method for manufacturing a thick asphalt sheet which includes preparing a thick sheet material made of non-woven fabric of synthetic fibers and impregnating said sheet material from its both sides with a molten petroleum asphalt material or molten petroleum asphalt materials of different kinds, respectively, to form a thick asphalt sheet.

The present invention further relates to a method for making a waterproofing surface by using the thick asphalt sheet thus manufactured.

2. Description of the Prior Art:

Heretofore, an asphalt sheet, usually called as an asphalt roofing, which is one of waterproofing materials, has been manufactured by firstly preparing a sheet material made of waste cotton pieces, staple fibers of synthetic material or the like and impregnating said sheet material with molten asphalt material. The asphalt roofing heretofore manufactured has a thickness of about 1 mm and, consequently, it has a relatively low strength against tension. Accordingly, if such asphalt roofing is used to cover a concrete ground, it cannot follow a crack which may be produced on the surface of the concrete ground, so that the asphalt roofing becomes cracked. In order to form a crackless waterproofing layer on a concrete ground, it was heretofore required to put two or more layers of the asphalt roofing on the concrete ground. Such construction of two or more asphalt roofing layers requires complicated operations and, during the period where the weather is changeable, the waterproofing work requires relatively long period, and the construction work may be delayed.

In order to eliminate such disadvantages of the prior art owing to defects of material or complicated work as required, a new asphalt sheet was recently developed. This newly developed asphalt sheet is manufactured by preparing a sheet material having a thickness of about 6 mm made of endless and long fibers of synthetic material by so-called needle punching process, using paste material, and impregnating said sheet material with molten petroleum asphalt. The new asphalt sheet has a thickness three to four times as much as that of the conventional asphalt sheet and it is formed by a sheet material made of long and endless fibers which are entangled together into an integral body. Accordingly, it has a high strength against tension and a capability of following a relatively large crack which may be produced in a surface of a concrete ground. Thus, the above newly developed asphalt sheet is expected to be an asphalt roofing which provides a perfect waterproofing property and which can attain its object only by applying one layer of the asphalt sheet.

The newly developed asphalt sheet, however, has a disadvantage in that it is very difficult to completely impregnate the thick sheet material of non-woven fabric with molten asphalt material having high viscosity.

Upon the extensive study, we developed various methods of impregnating the thick sheet material of non-woven fabric with molten asphalt material. One of these methods employs rolls having needle-like projections thereon to form apertures in the sheet material, so that the molten asphalt material can pass into the central portion of the sheet material through the apertures formed in the sheet material. The other method employs an asphalt melting tank having great depth, in which the molten asphalt material can pass into the central portion of the sheet material under the action of hydraulic pressure difference and temperature difference.

These methods, however, have such disadvantages that the processing speed is low, so that it is difficult to attain a desired production efficiency, and the equipment used is of large-scale, owing to inclusion of the asphalt melting tank in any case.

SUMMARY OF THE INVENTION

It is an object of the present invention to eliminate the above-mentioned disadvantages in the conventional method for manufacturing a thick asphalt sheet and provide a method for manufacturing a thick asphalt sheet in effective manner.

In accordance with an aspect of the present invention, there is provided a method for manufacturing a thick asphalt sheet which comprises preparing a thick sheet material made of non-woven fabric of synthetic material, passing said sheet material through at least one pair of pressing rolls from the upper side to the lower side and feeding and storing molten petroleum asphalt into a concavity formed on the upper side of said pair of rolls, whereby the molten petroleum asphalt is pressed into the sheet material when said material passes through said pair of rolls.

In accordance with another aspect of the present invention there is provided a method for manufacturing a thick asphalt sheet which comprises preparing a thick sheet material made of non-woven fabric of synthetic material, passing said sheet material through a series of three or four stages of pairs of heated pressing rolls from the upper side to the lower side of each pair of rolls and feeding and storing molten petroleum asphalt into concavities formed on the upper sides of the respective pairs of rolls, excluding the lowest stage of pair of rolls, whereby the molten petroleum asphalt is pressed into the sheet material when said material passes through said pairs of rolls.

In accordance with another aspect of the present invention there is provided a method for manufacturing a thick asphalt sheet which comprises preparing a thick sheet material made of non-woven fabric of synthetic material, passing said sheet material through a series of odd number of stages, three or five stages, of pairs of heated pressing rolls from the upper side to the lower side of each pair of rolls, feeding and storing a kind of molten petroleum asphalt into a concavity formed on the uppermost stage of pairs of rolls, at one side of the sheet material while feeding and storing another kind of molten waterproofing material, such as molten synthetic material, into a concavity formed on the next stage of pair of rolls, at the opposite side of the sheet material and repeating the above-mentioned feeding and storing of the molten petroleum asphalt and the molten waterproofing material, in case where the sheet material is passed through five stages of pairs of rolls, whereby the different kinds of molten waterproofing materials are pressed into the opposite sides of the sheet material.

In accordance with a further aspect of the present invention, there is provided a method for forming a waterproofing layer on a processed ground surface which comprises preparing a thick sheet material made of non-woven fabric of synthetic material, passing said sheet material through one pair of heated pressing rolls from the upper side to the lower side, feeding and storing molten petroleum asphalt into a concavity formed on the upper side of said pair of rolls, thereby impregnating said sheet material with the molten petroleum asphalt to form an asphalt sheet, and immediately thereafter applying said asphalt sheet onto a processed ground surface, whereby a waterproofing layer is formed on a processed ground surface.

BRIEF DESCRIPTION OF THE DRAWINGS

The invention will be explained with reference to the drawings in which.

DESCRIPTION OF THE PREFERRED EMBODIMENTS

Now, the preferred embodiments of the present invention will be explained with reference to the accompanying drawings.

Figure 1:
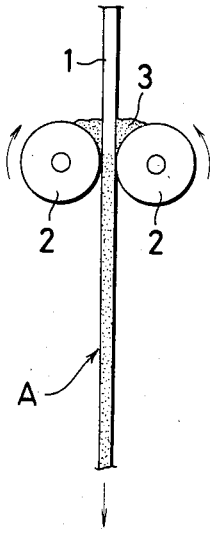
FIG. 1 illustrates an embodiment of the method according to the present invention.

FIG. 1 illustrates an embodiment of the method for manufacturing the asphalt sheet according to the present invention. The method as illustrated in FIG. 1 makes use of a pair of pressing rolls 2 and 2. The pressing rolls have heating device contained therein to heat the same to the temperature near the melting point of the petroleum asphalt.

A thick sheet material 1 made of non-woven fabric of synthetic material is passed through the pair of pressing rolls 2 and 2, from the upper side to the lower side. Molten petroleum asphalt 3 is fed and stored into a concavity formed on the upper side of said pair of rolls. In the embodiment as shown in FIG. 1, the molten petroleum asphalt 3 is fed and stored at both sides of the sheet material 1.

The rolls 2 and 2, which are heated and pressed to each other, are rotated in opposite directions to move the sheet material in downward direction. The molten asphalt stored in the concavity on the upper side of said rolls are pressed into the central portion of the sheet material under the action of the pressing force of the rolls and the restoring force of the sheet material of non-woven fabric at the time when the pressed sheet material is released from the pressing force of the rolls. Thus a complete asphalt sheet A is obtained.

The petroleum asphalt used may be any one of blown asphalt, denatured asphalt and rubberized asphalt. Although they have some difference in melting point, they can be used in substantially same manner provided that the temperature of the heated rolls must be adjusted.

Figure 2:
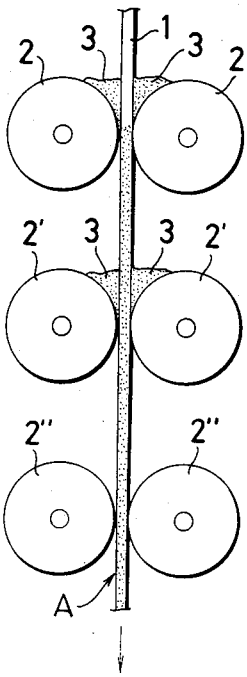
FIGS. 2, 3 and 4 illustrate other embodiments of the present invention, respectively.

FIG. 2 illustrates another embodiment of the invention, in which a thick sheet material 1 made of non-woven fabric of synthetic material is passed through a series of plural stages of pairs of heated pressing rolls 2, 2′ and 2″ to impregnate said thick sheet material 1 with molten petroleum asphalt 3 from both sides of said sheet material simultaneously.

Although the system shown in FIG. 2 includes three stages of pairs of pressing rolls, this system may include four or more stages of pairs of pressing rolls. The sheet material 1 made of non-woven fabric is passed through the respective pairs of pressing rolls. The pair of rolls 2″ and 2″, at the bottom stage, are simply arranged to be heated and pressed together as shown in FIG. 2. The molten asphalt material is stored only on concavities formed on the pairs of rolls at the upper stages and the sheet material 1.

In the embodiment shown in FIG. 2, where the pairs of heated pressing rolls 2, 2′ and 2″ are arranged as shown in FIG. 2 and the sheet material 1 is moved in the downward direction, as the sheet material is moved the molten asphalt 3 is pressed into the central portion of the sheet material 1 successively by means of the rolls 2 at the upper stage and then by the rolls 2′ at the next stage. Finally the sheet material is pressed by means of the pair of rolls 2″ at the lowest stage. Thus, the sheet material is completely impregnated with the molten petroleum asphalt, thereby forming an asphalt sheet A.

The asphalt used may be any one of blown asphalt, denatured asphalt and rubberized asphalt.

Figure 3:
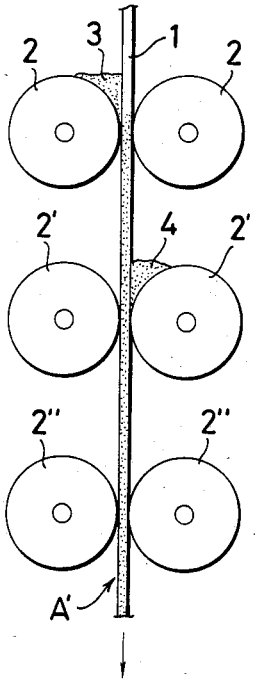

FIG. 3 illustrates a further embodiment of the invention, in which a thick sheet material 1 made of non-woven fabric of synthetic material is passed through a series of plural stages of pairs of heated rolls. In this case, the sheet material 1 is impregnated from its front and rear sides with different kinds of asphalt 3 and 4, thereby producing an asphalt sheet having same property as that of an asphalt sheet including two layers which are different in characteristics, such as strength against tension, tearing and/or shearing.

The sheet material 1 is passed through a series of odd number of stages, three or five stages, of pairs of heated pressing rolls 2, 2′ and 2″. (Although three stages of pairs of rolls are shown in FIG. 3, this system may include five stages of pairs of rolls.) The sheet material 1 passes through the nips of the respective rolls.

The rolls 2″ at the bottom stage are simply arranged to be heated and pressed together, as shown in FIG. 3. The pressing rolls 2 at the top stage are arranged to receive and store a kind of the molten asphalt 3 in a concavity formed by one of said rolls 2 at one side of the sheet material, and the sheet material 1. The pressing rolls 2′ at the next stage are arranged to receive and store a different kind of the molten asphalt 4 in a cavity formed by one of said rolls 2′, at the opposite side of the sheet material 1, and the sheet material 1. In case where five stages of pressing rolls are included, the arrangement of the pressing rolls as explained above is repeated.

In the embodiment shown in FIG. 3, where the pairs of heated pressing rolls 2, 2′ and 2″ are arranged as shown in FIG. 3 and the sheet material 1 is moved in the downward direction, as the sheet material is moved, the molten asphalt 3 is pressed into the central portion of the sheet material 1, only from its one side, by means of the rolls 2 at the top stage while the molten asphalt 4 of different kind is pressed into the unimpregnated portion of the sheet material 1, from the opposite side, by means of the rolls 2′ at the next stage. The sheet material thus impregnated with two kinds of molten asphalt is heated and pressed by means of the rolls 2″ at the bottom stage, whereby an asphalt sheet A′ impregnated with different kinds of asphalt at its front and rear sides is produced.

The asphalt used may be any one of blown asphalt, denatured asphalt, rubberized asphalt and synthetic resin. The combination may be varied as desired.

Figure 4:
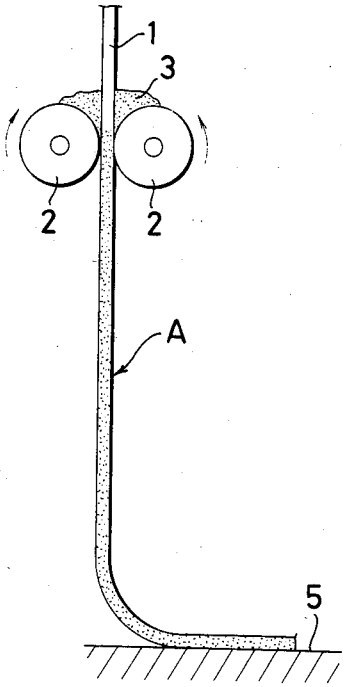

FIG. 4 illustrates an embodiment of the invention in which the asphalt sheet A manufactured by the method according to FIG. 1 is directly applied to form a waterproofing layer on a processed ground at the working site. A self-running type of asphalt melting tank (not shown) may be used, in combination with the asphalt sheet producing device according to the present invention, in order to directly apply the asphalt sheet A onto a concrete ground surface 5 which has been processed by an asphalt primer.

The conventional method for manufacturing an asphalt sheet requires a large scale asphalt melting tank in which the sheet material is to be immersed, while the method according to the present invention does not require such asphalt melting tank but only requires the provision of at least one pair of pressing rolls through which the sheet material is to be passed. In the method according to the present invention, the sheet material is impregnated with the molten asphalt under the action of the pressing force of said pressing rolls and the restoring force of the sheet material when it is released from the pressing force of the rolls, so that the sheet material can be completely impregnated to the central portion thereof with the molten asphalt, whereby a thick asphalt sheet can be very easily produced. If a plurality of pairs of pressing rolls are arranged in a plurality of stages, as shown in FIGS. 2 and 3, the non-woven fabric of the sheet material is impregnated with the molten asphalt successively in a plurality of steps and consequently the sheet material becomes completely impregnated with the molten asphalt material even if the sheet material has relatively great thickness. Furthermore, the sheet material is subjected to heat pressing treatment by the pressing rolls at the bottom stage, so that the sheet material is uniformly impregnated with the molten asphalt, without causing uneven impregnation. The sheet material is subjected to the impregnating treatment while it is moving through the pressing rolls, and consequently higher processing speed is obtained as compared with the conventional method in which the sheet material is subjected to the impregnating treatment while it is immersed in the melting tank.

Now, the present invention will be explained with reference to some examples.

EXAMPLE 1

The device shown in FIG. 1 was used. The sheet material of non-woven fabric was prepared from long endless fibers of polypropylene. The thickness was 5 mm, the number of needle-punches was 150/cm$^2$, and the asphalt for impregnation was blown asphalt having softening point of 100° C. and penetration of 35. The temperature of the molten asphalt was 160° C.

The pressing roll was a metallic roll having diameter of 20 cm. The roll had a heater contained therein, which was adjusted to hold the surface temperature of said roll at the temperature of 180° C. The length of the roll was 2 m, which corresponds to the width of the sheet material. The weight of the molten asphalt fed and held on the rolls was 12 kg. The molten asphalt was successively supplied as the molten asphalt was absorbed by the sheet material.

The pressing rolls were pressed together at the pressure of 30 kg/cm$^2$ and these pressing rolls were arranged in opposite relationship, with a minimum distance being 2 mm. The feeding speed of the sheet material of non-woven fabric was 15 m/min.

The asphalt sheet A, thus manufactured had thickness of 5.2 mm. The sheet was cut and the section thereof was subjected to electron microscope test. It was observed that the asphalt was completely passed to the center of the sheet.

EXAMPLE 2

The device shown in FIG. 2 was used. The sheet material of non-woven fabric was prepared from long endless fibers of polypropylene. The thickness was 6 mm, the number of needle-punches was 140/cm$^2$, and the asphalt for impregnation was blown asphalt having softening point of 95° C. and penetration of 35. The temperature of the molten asphalt was 150° C.

Each of the pressing rolls was a metallic roll having diameter of 20 cm. The roll had a heater contained therein, which was adjusted to hold the surface temperature of the same at a temperature of 160° C. The length of the roll was 2 m, which corresponds to the width of the sheet material. The weight of the molten asphalt on one stage of the rolls was 12 kg and the molten asphalt was successively supplied.

The pressing rolls were arranged in three stages and the respective pressing rolls were pressed together at the pressure of 30 kg/cm$^2$. The feeding speed of the sheet material of non-woven fabric was 14 m/min. The asphalt sheet A thus manufactured was cut and the section was subjected to electron microscope test. It was observed that the asphalt was completely passed to the center of the sheet.

EXAMPLE 3

The device shown in FIG. 2 was used. The shape of the pressing roll, the pressing pressure of the rolls, and the surface temperature of the roll were same as those described in Example 1. The pressing rolls were arranged in three stages.

6 kg of the molten blown asphalt was fed and held on one of the pressing rolls at the top stage, while 6 kg of molten, rubberized asphalt having softening point of 105° C. and penetration of 37 was fed and held on one of the pressing rolls at the next stage and held at the temperature of 155° C.

The sheet material of non-woven fabric was the one which had thickness of 6 mm produced by needle-punching process, and it was fed at the speed of 12 m/min. The asphalt sheet A' thus manufactured was cut and the section thereof was subjected to electron microscope test. It was observed that the asphalt was completely passed to the central portion of the sheet from both sides thereof substantially uniform manner.

What is claimed is

1. A method for manufacturing a thick asphalt sheet comprising preparing a thick sheet material made of non-woven fabric of synthetic material, passing said sheet material through at least one pair of pressing rolls from the upper side to the lower side and feeding and storing molten petroleum asphalt into a concavity formed on the upper side of said pair of rolls, whereby the molten petroleum asphalt is pressed into the sheet material when said material passes through said pair of rolls.

2. A method for manufacturing a thick asphalt sheet comprising preparing a thick sheet material made of non-woven fabric of synthetic material, passing said sheet material through a series of three or four stages of pairs of heated pressing rolls from the upper side to the lower side of each pair of rolls and feeding and storing molten petroleum asphalt into concavities formed on the upper sides of the respective pairs of rolls, excluding the lowest stage of pair of rolls, whereby the molten petroleum asphalt is pressed into the sheet material when said material passes through said pairs of rolls.

3. A method for manufacturing a thick asphalt sheet comprising preparing a thick sheet material made of non-woven fabric of synthetic material, passing said sheet material through a series of odd number of stages, three or five stages, of pairs of heated pressing rolls from the upper side to the lower side of each pair of rolls, feeding and storing a kind of molten petroleum asphalt into a concavity formed on the uppermost stage of pairs of rolls, at one side of the sheet material while feeding and storing another kind of molten waterproofing material, such as molten synthetic material, into a concavity formed on the next stage of pairs of rolls, at the opposite side of the sheet material, and repeating the above-mentioned feeding and storing step of the molten petroleum asphalt and the molten waterproofing material, in case where the sheet material is passed through five stages of pairs of rolls, whereby the different kinds of molten waterproofing materials are pressed into the opposite sides of the sheet material.

4. A method for forming a waterproofing layer on a processed ground surface comprising preparing a thick sheet material made of non-woven fabric of synthetic material, passing said sheet material through one pair of heated pressing rolls from the upper side to the lower side, feeding and storing molten petroleum asphalt into a concavity formed on the upper side of said pair of rolls, thereby impregnating said sheet material with the molten petroleum asphalt to form an asphalt sheet, and immediately thereafter applying said asphalt sheet onto a processed ground surface, whereby a waterproofing layer is formed on a ground surface.

5. A method according to claim 1 wherein the thick sheet material employed has a thickness of 5 to 6 mm.

6. A method according to claim 2 wherein the thick sheet material employed has a thickness of 5 to 6 mm.

7. A method according to claim 3 wherein the thick sheet material employed has a thickness of 5 to 6 mm.

8. A method according to claim 4 wherein the thick sheet material employed has a thickness of 5 to 6 mm.

* * * * *